United States Patent [19]

Freissle

[11] Patent Number: 4,882,044

[45] Date of Patent: Nov. 21, 1989

[54] SCREENING ARRANGEMENT

[75] Inventor: Manfred F. A. Freissle, Aschau-Chiemgau, Fed. Rep. of Germany

[73] Assignee: Polydeck Screen Corporation, Spartanburg, S.C.

[21] Appl. No.: 207,400

[22] Filed: Jun. 16, 1988

[30] Foreign Application Priority Data

Sep. 26, 1987 [GB] United Kingdom ..... 8722672
Mar. 19, 1988 [GB] United Kingdom ..... 8806575

[51] Int. Cl.[4] ..... B07B 1/46

[52] U.S. Cl. ..... 209/319; 209/397; 209/399; 209/405; 209/408

[58] Field of Search ..... 209/311, 315, 319, 353, 209/355, 392, 397, 399, 400, 401, 403–405, 408, 409, 412, 414; 264/DIG. 70; 425/DIG. 119

[56] References Cited

U.S. PATENT DOCUMENTS

| | | | |
|---|---|---|---|
| 3,565,251 | 2/1971 | Pennington | 209/405 X |
| 3,980,555 | 9/1976 | Freissle | 209/408 |
| 4,141,821 | 2/1979 | Wolff | 209/395 X |
| 4,265,742 | 5/1981 | Bucker et al. | 209/405 X |
| 4,347,129 | 8/1982 | Rutherford | 209/408 X |
| 4,409,099 | 10/1983 | Wolff | 209/405 X |
| 4,661,245 | 4/1987 | Rutherford et al. | 209/412 X |
| 4,762,610 | 8/1988 | Freissle | 209/408 X |

FOREIGN PATENT DOCUMENTS

| | | | |
|---|---|---|---|
| 8303782 | 8/1985 | Fed. Rep. of Germany . | |
| 3542635 | 2/1987 | Fed. Rep. of Germany | 209/397 |
| 606854 | 9/1987 | Fed. Rep. of Germany | 209/319 |

*Primary Examiner*—Dennis H. Pedder
*Assistant Examiner*—Edward M. Wacyra
*Attorney, Agent, or Firm*—Curtis, Morris & Safford

[57] ABSTRACT

The invention provides for a screening panel of a synthetic plastics material which has a screening surface and plug socket connections adapted to secure the panel releasably in a side-by-side relationship with similar panels. The panel includes a spacer element along one peripheral edge of the panel and extending in a direction transverse to the screening surface of the panel and being integral and unitary with the panel so that in side view the panel is substanitally L-shaped. The spacer element is adapted to space the screening surface of the panel from a second screening surface substantially parallel to the screening surface of the panel to thereby form a double screen deck supported on the same support frame.

14 Claims, 8 Drawing Sheets

SCREENING ARRANGEMENT

BACKGROUND TO THE INVENTION

THIS INVENTION relates to a screening arrangement. The invention relates in particular to a screening arrangement for screening particulate materials such as mineral ores. More particularly the invention relates to screening panels and to screen decks.

The applicant is aware of screening arrangements which are of a modular configuration comprising a plurality of panels which are releasably secured in a side-by-side relationship on a support frame to thereby form a screen deck. It is also known to the applicant that more than one such screen deck can be provided the one above the other so that material to be screened which passes through the upper screen deck can fall onto the lower screen deck to be screened further so that thereby progressively finer particles can be removed from the material being screened.

It is an object of the invention to provide a screening arrangement which includes more than one screen deck above each other, which is compact and which has as few components as possible.

According to the invention there is provided a screening panel predominantly of a synthetic plastics material and having a screening surface in which screening apertures are provided and having securing means adapted to secure the panel releasably in a side-by-side relationship with similar panels, the panel including at least one spacer element along one peripheral edge of the panel and extending in a direction transverse to the screening surface of the panel and being integral and unitary with the panel so that in side view the panel is substantially L-shaped, the spacer element being adapted to space the screening surface of the panel from a second screening surface substantially parallel to the screening surface of the panel so that screened material passing through one of the screening surfaces can fall onto the other screening surface to be screened further by that screening surface.

The spacer element may be adapted to support the second screening surface above the screening surface of the panel so that the screening surface of the panel is spaced below the second screening surface. In this arrangement the securing means on the screening panel may comprise a plurality of deformable spigot-like protrusions spaced from each other along the peripheral region of the panel. The protrusions may be adapted to fit in pairs with the protrusions of an adjacent similar panel in complementary spaced apertures in a support frame. The protrusions may be solid. Alternatively, the protrusions may be half-tubular so that when such protrusions are fitted in pairs in the apertures of a support frame the protrusions form tubular bores into which securing pins may be fitted to spread the protrusions to engage the support frame.

Further securing means may be provided at the free end of the spacer element adapted to releasably secure further screening panels forming the second screening surface to the screening panel so that the second screening surface is positioned above the screening surface of the panel. The securing means at the free end of the spacer element may include a plurality of spaced blind bores.

A sloping ridge may be provided at the side of the screening panel remote from and parallel to the spacer element.

In an alternative arrangement, the spacer element may be adapted to space the screening surface of the screening panel above the second screening surface. In this arrangement the securing means on the screening panel may comprise spaced apertures along an edge of the panel and complementary apertures of the panel, and securing pins adapted to be removably inserted into the aligned apertures to secure the panel to the spacer element.

Further securing means may be provided at the free end of the spacer element adapted to releasably secure the spacer element and thus the panel to a support frame. The securing means on the spacer element may be protrusions adapted to releasably engage complementary apertures in the support frame.

The securing means on the spacer element may be adapted to secure a further set of screening panels forming the second screening surface to the support frame.

An aperture may be provided in a sideways direction through the spacer element to permit material on the screening surface of the screening panel to flow in a sideways direction through the spacer element.

The invention further extends to a screen deck including at least two decks and a support frame supporting both decks, one deck comprising a plurality of screening panels in accordance with the invention arranged side-by-side, and the other deck comprising a plurality of further screening panels arranged side-by-side, the decks being vertically spaced from each other.

The screening panels in adjacent longitudinal rows of panels in at least one of the decks may be staggered from each other in a transverse direction.

The screening panels may have screening surfaces of synthetic plastics material, the screening panel then being substantially entirely of synthetic plastics material. Alternatively, the screening surface of the screening panel may be of metal in the form of a metal sieve embedded in a surround of synthetic plastics material.

The invention is now described with reference to the accompanying drawings, in which.

Figure 7:
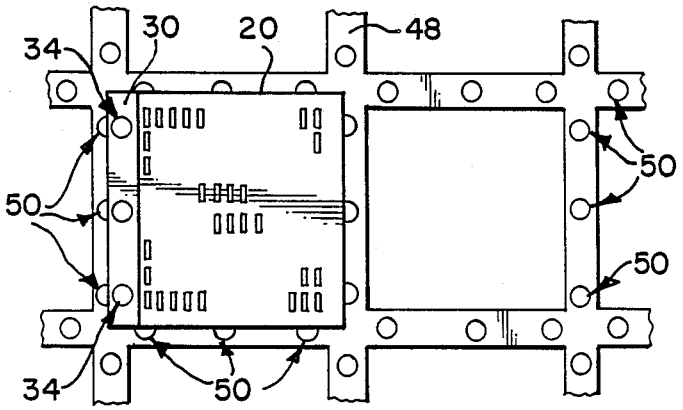
FIG. 7 shows a fragmentary plan view of a screen deck comprising one screen panel as in FIG. 1 in position on a support frame.
Figure 10:
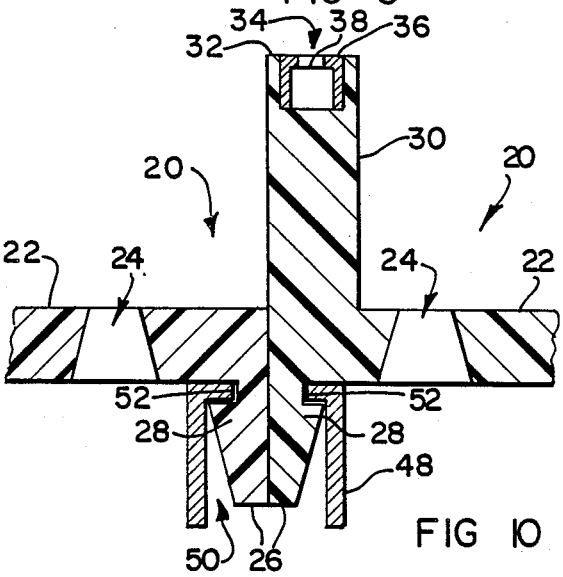
FIG. 10 shows on an enlarged scale a fragmentary section along line X—X of FIG. 8.

Referring to FIGS. 1 to 4 of the drawings, reference numeral 20 indicates in general a screening panel which is of L-shape in side view and which is of a hard-wearing synthetic plastics material, for example polyurethane having a Shore hardness of 70 to 90, depending on the type of particulate material to be screened. The panel has a screening surface 22 including a plurality of screening apertures 24. The panel has a plurality of protrusions 26 provided along the entire peripheral edge of the panel 20 as shown, or it may be provided along only some of the peripheral edges of the panel. The protrusions 26 are spigot-like of tapering configuration and with shoulders 28 which can abut a support frame in which the protrusions are fitted as shown in FIG. 7. The protrusions 26 are of the same material as the panel 20 and are integral with the panel and are resiliently deformable to permit the protrusions to be inserted into and to be removed from apertures in a support frame as shown in FIG. 10.

The screening panel 20 further includes a spacer element 30 which is integral and unitary with the panel and of the same material as the panel and projects above the screening surface 22. In the top surface 32 of the spacer element 30 there are provided three spaced sockets 34. Each socket 34 is lined with a metal sleeve 36 having an annular ridge 38 whose function is decribed with reference to FIG. 13.

Figure 4:
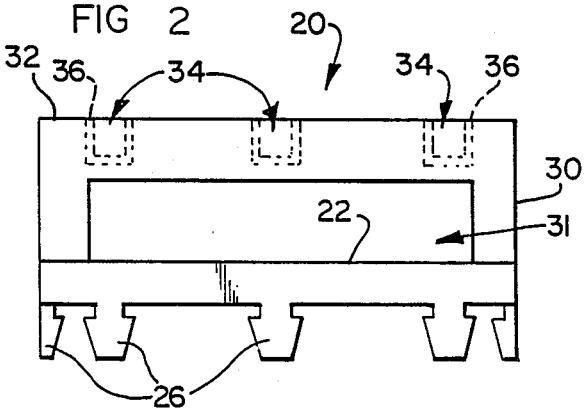
FIG. 4 shows an end view of the screening panel shown in FIG. 2.

Referring to FIG. 4, it is shown that the spacer element 30 is of a frame-like configuration through which an aperture 31 is provided. The aperture 31 not only saves material but also permits material to be screened to flow through the aperture from one panel to the next, over the screen deck formed by the panels.

Figure 1:
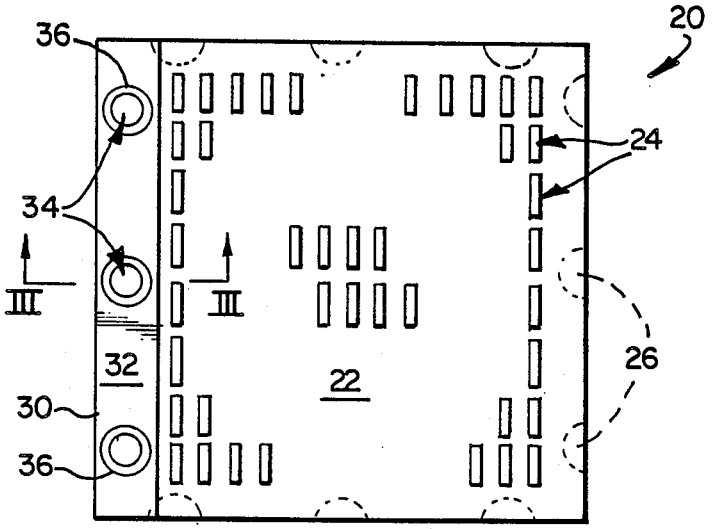
FIG. 1 shows a plan view of a screening panel in accordance with the invention having a spacer element along one peripheral edge of the panel.
Figure 5:
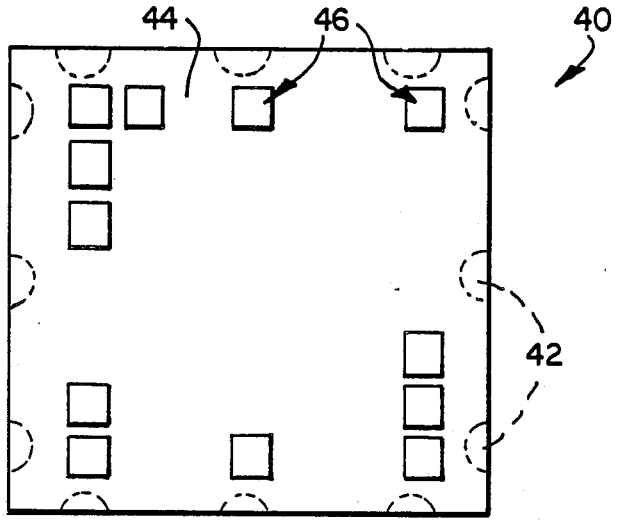
FIG. 5 shows a screening panel similar to the screening panel shown in FIG. 1, but without a spacer element.
Figure 6:
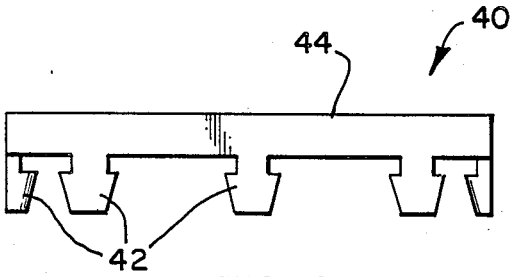
FIG. 6 shows a side view of the screening panel shown in FIG. 5.

Referring to FIGS. 5 and 6, reference numeral 40 indicates a further screening panel similar to the screening panel 20 shown in FIG. 1 except that it does not have a spacer element 30. It has protrusions 42 similar to the protrusions 26 of screening panel 20. It further has a screening surface 44 in which are defined screening apertures 46 which are of a larger mesh size than the screening apertures 22 of the panel 20. The screening panel 40 is of the same or of a similar material to that of screening panel 20.

The screen panels 20 and 40 may be entirely or predominantly of synthetic plastics material, in which case the screening surfaces 22 and 44 may also be of synthetic plastics material. Alternatively, if desired, the screening surfaces 22 and/or 44 may be formed by metal sieves (not shown) embedded in the panels 20 and 40.

Referring to FIG. 7, there is shown a screen deck comprising a support frame 48 with a screening panel 20 of FIG. 1 positioned thereon. The support frame 48 is a latticework of steel sections of L- or U-cross-section. A plurality of apertures 50 are provided in the support frame 48, the spacing between the apertures 50 corresponding to the spacing of the protrusions 26 of the panel 20 from each other, the protrusions 26 being shown in FIG. 2. The panel 20 is fitted onto the support frame 48 by inserting the protrusions 26 into the apertures 50.

Figure 8:
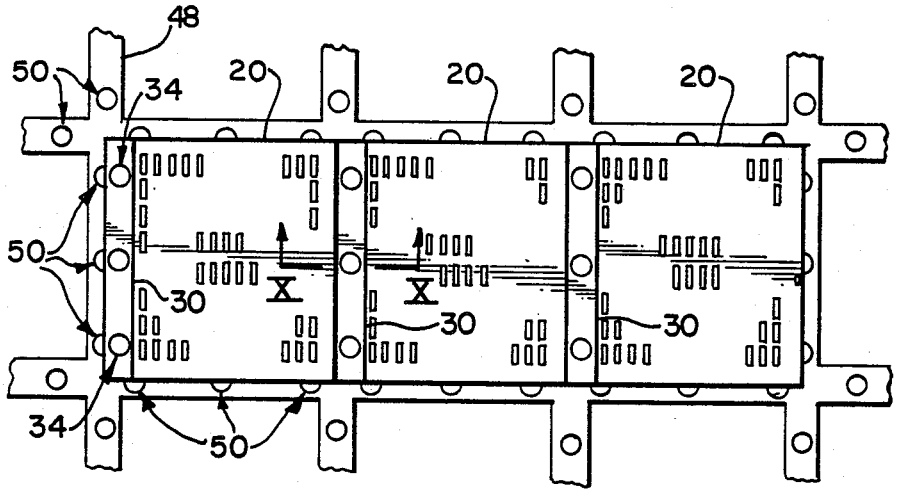
FIG. 8 shows a fragmentary plan view of a screen deck similar to that shown in FIG. 7 but with three screening panels of FIG. 1 in position on a support frame.
Figure 9:
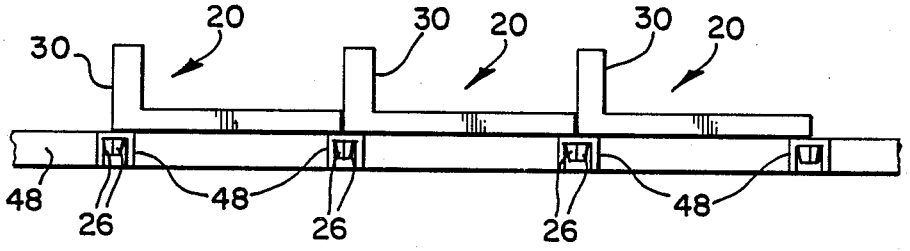
FIG. 9 shows a side view of the screen deck shown in FIG. 8.

FIGS. 8 and 9 show a screen deck similar to that shown in FIG. 7 except that three screening panels 20 are fitted adjacent each other in a side-by-side abutting relationship on the support frame 48. The protrusions 26 on adjacent screening panels 20 re fitted in pairs into the apertures 50 in the support frame 48 as shown in FIG. 10. As shown, the shoulders 28 on the tapering protrusions 26 abut the rim 52 of the frame 48 defining the aperture 50. Since the protrusions 26 are of a deformable synthetic plastics material they can be withdrawn from the apertures 50 to release the panels 20. It is also shown in FIG. 10 that the screening apertures 24 taper slightly downwardly in order to prevent blocking of the apertures by particles lodging therein.

Figure 11:
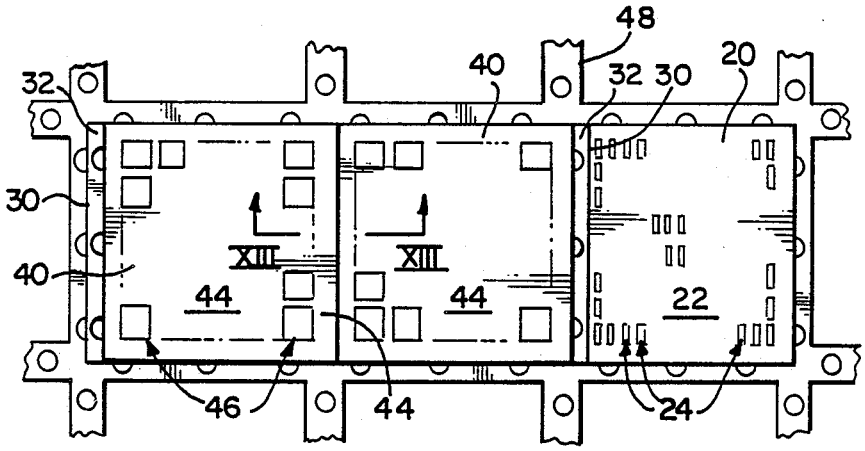
FIG. 11 shows a fragmentary plan view of a double screen deck comprising two screening panels of FIG. 1 positioned over the screen deck of FIG. 8.
Figure 12:
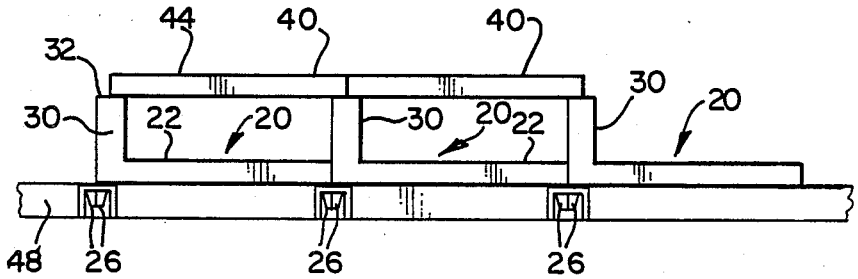
FIG. 12 shows a side view of the screen deck of FIG. 11.
Figure 13:
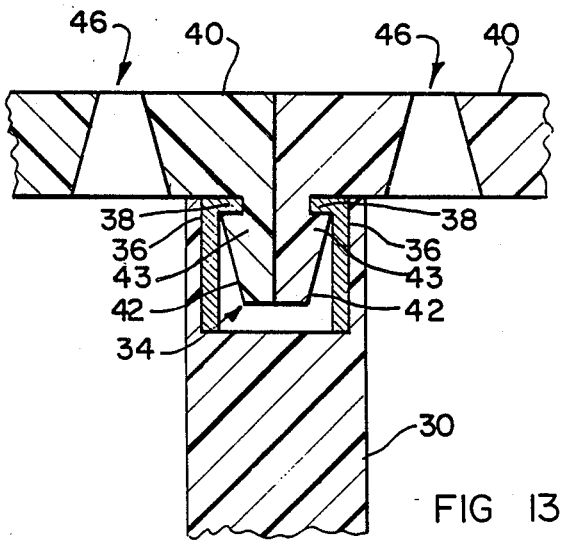
FIG. 13 shows, on an enlarged scale, a fragmentary section along line XIII—XIII of FIG. 11.

Referring to FIGS. 11, 12 and 13, there is shown a double screen deck comprising two screening panels 40 of FIG. 5 positioned on top of the screening panels 20 of the screen deck shown in FIGS. 7 and 8. The screening panels 40 are secured above and onto the screening panels 20 along the top surfaces 32 of the spacer elements 30. The securing arrangement is shown in greater detail in FIG. 13. The protrusions 42 on the screening panels 40 are secured in pairs in the sockets 34 provided in the top surfaces 32 of the spacer elements 30. Ridges 43 on the tapering protrusions 42 engage the annular shoulder 38 provided in the metal sleeve 36 which lines each socket 34. By being of a deformable synthetic plastics material the protrusions 42 can be deformed to be withdrawn from the sockets 34 and thereby the screening panels 40 can be removed from the spacer elements 30 of the lower screening panels 20.

Referring further to FIG. 12, it can be seen that the double screen deck there illustrated comprises the support frame 48, the first deck of screening panels 20 on top of the support frame 48, and the second deck of screening panels 40 secured on top of the screening panels 20. Thus, material to be screened is first deposited on the screening surface 44 of the uppermost screening panels 40 which have larger screen aperture sizes. Material which passes through the screen apertures 46 of the screening surface 44 drop onto the screening surfaces 22 of the lower screening panels 20 and are subjected to further screening. The screening surfaces 22 screen out material having a particle size smaller than the aperture size of the screening apertures 44 but larger than the aperture size of the screening apertures 24 of the screening surface 22. Material having a particle size smaller than the aperture size of the apertures 24 passes through the apertures 24. Thus the effect is that the material is screened progressively finer through the double screen deck formed by the screening panels 40 and 20.

In a further arrangement (not shown) a screen deck with more than two decks may be formed. This may be achieved, with reference to FIG. 12, by fitting in the place of the upper deck of panels 40, a second deck of screening panels 20, and then fitting on top of the second screen of screening panels 20 the deck of screening panels 40. Thereby a triple screen deck is formed.

Figure 14:
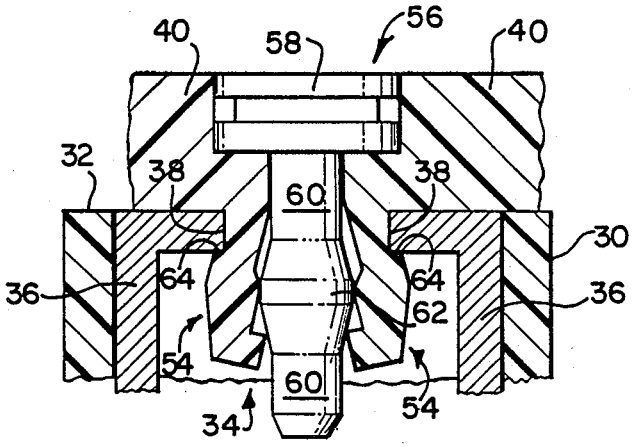
FIG. 14 shows a view similar to FIG. 13 but with an alternative securing arrangement for the panels.

Referring to FIG. 14, there is shown an alternative securing arrangement to that shown in FIG. 13 for securing the panels 40 to the spacer element 30. In this arrangement half-tubular protrusions 54 are provided on the panels 40 instead of the solid protrusions 42 shown in FIG. 13. The half-tubular protrusions 54 are also fitted in pairs in the socket 34 provided in the top surface 32 of the spacer element 30. When the protrusions are thus fitted, a loose pin 56 also of a synthetic plastics material is inserted into the bore formed by the two half-tubular protrusions 54. The pin 56 has a head 58, a stem 60, and a thickened portion 62 on the stem 60. When the pin 58 is thus inserted, the thickened portion 62 on the stem 60 forces the half-tubular protrusions 54 apart, the protrusions being of a deformable synthetic plastics material. Ridges 64 on the protrusions are thereby forced to engage the annular shoulder 38 on the metal sleeve 36 and thereby the panels 40 are secured to the spacer element 30 via the shoulder 38 on the sleeve 36.

Figure 2:
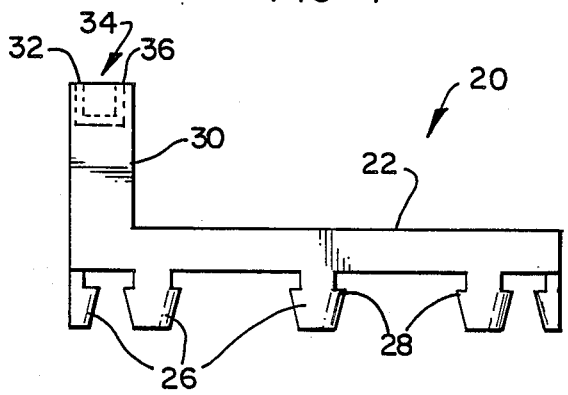
FIG. 2 shows a side view of the screening panel shown in FIG. 1.
Figure 3:
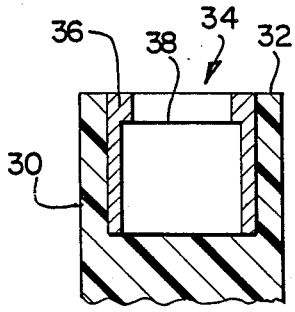
FIG. 3 shows on a enlarged scale a fragmentary section along III—III of FIG. 1.
Figure 15:
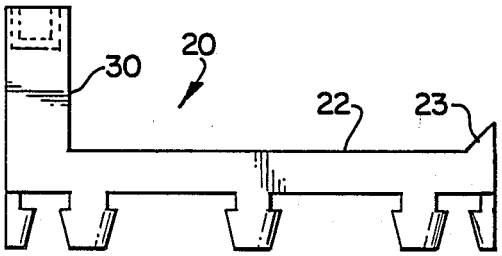
FIG. 15 shows a view similar to FIG. 2 but with a ridge on the panel.

Referring to FIG. 15, there is shown a screening panel 20 identical to the screening panel 20 shown in FIG. 2 except that it is provided with a ridge 23 on the screening surface 22 of the panel along an edge of the panel parallel to and remote from the spacer element 30. The function of the ridge 23 is to prevent material to accumulate in the corner where the screening panel 20 abuts an adjacent screening panel 20 as shown in FIG. 10. As can be seen from FIG. 10, no screening apertures can be provided in the corner region since the fixing protrusions 22 are provided in this region. The sloping ridge 23 deflects the material into the screening apertures 24 shown in FIG. 10.

Figure 16:
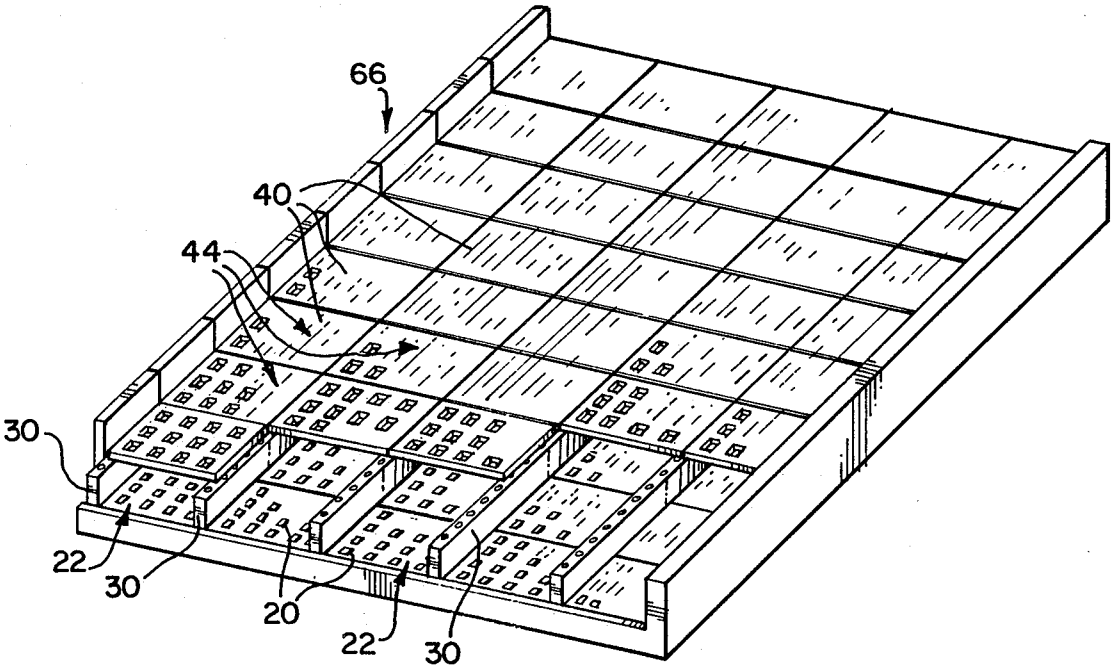
FIG. 16 shows an oblique fragmentary plan view of a double screen deck in accordance with the arrangement shown in FIG. 12.

Referring to FIG. 16, there is shown an oblique plan view of a double screen deck 66 formed in the manner described with reference to FIGS. 11 and 12. The double screen deck 66 includes a lower deck consisting of screening panels 20 having screening surfaces 22 and spacer elements 30, and an upper screen deck formed from screening panels 40 having screening surfaces 44. The support frame 48 shown in FIGS. 11 and 12 is not shown in FIG. 16.

Figure 17:
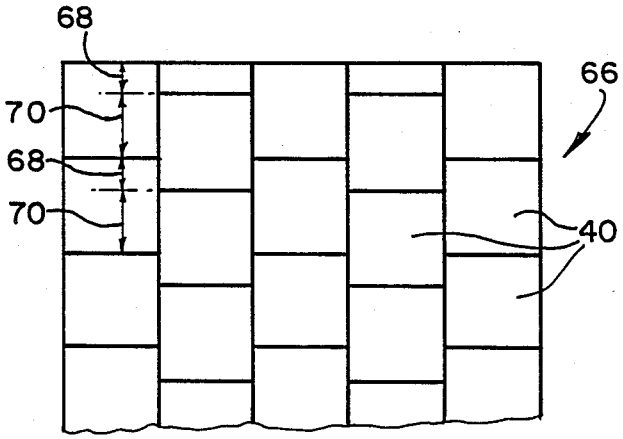
FIG. 17 shows a fragmentary diagrammatic plan view of the top deck of the double screen deck shown in FIG. 16.

Referring to FIG. 17, there is shown diagrammatically a fragmentary plan view of the double screen deck 66 shown in FIG. 16, but with an alternative arrangement of the panels 40 in the top deck of the double screen deck. In this arrangement the panels 40 in adjacent longitudinal rows are staggered from each other. The amount of staggering depends on how many fixing protrusions are provided on the top panels 40. In this case, as shown in FIGS. 5 and 6, the panels 40 have three protrusions 42 on each side. Thus, by staggering the panels by one protrusion, the amount of staggering is about one third of a panel length i.e. the distance 68 is about one third of a panel length, and the distance 70 is about two thirds of the panel length. The effect of staggering the panels as indicated is that transverse joining lines are prevented from being formed across the screen deck, and thereby the panels 40 of the top deck are interconnected more securely.

Referring to FIGS. 18 to 22 there is shown an alternative double screen deck 72 formed from another configuration of L-shaped screening panels 74 and further screening panels 76. It will be appreciated that the L-shape can be variations of an L-shape such as an inverted L-shape, reversed L-shape, or a mirror image L-shape. Each L-shaped panel 74 has a screening surface 78 in which screening apertures 79 are provided, and a spacer element 80. A recess 82 is provided in the panel above the spacer element 80 in which to receive the screening surface section 78 of an adjacent panel. Fixing protrusions 84 are provided on the spacer elements 80 for fixing the panels to a support frame 48. This fixing arrangement, and the fixing of the panel sections 78 to the spacer elements 80 by means of pins 86, are described in more detail with reference to FIG. 22.

Figure 18:
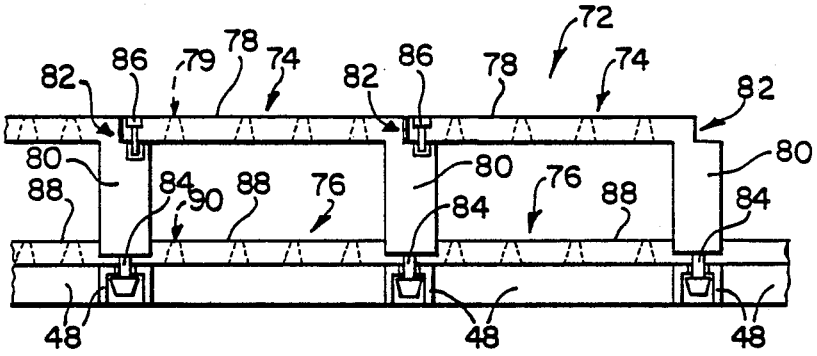
FIG. 18 shows diagrammatically a fragmentary side view of a double screen deck, including alternative screening panels to those included in the double screen deck shown in FIG. 12.
Figure 19:
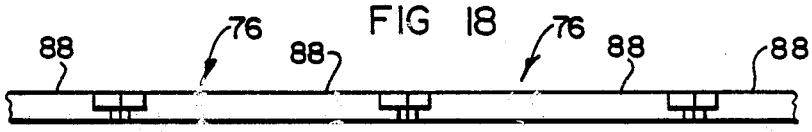
FIG. 19 shows diagrammatically a fragmentary side view of the lower deck of the double screen deck shown in FIG. 18.
Figure 20:
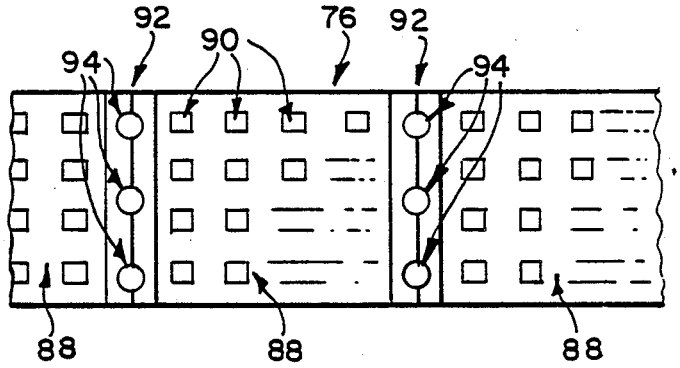
FIG. 20 shows a fragmentary plan view of the lower screen deck shown in FIG. 19.
Figure 21:
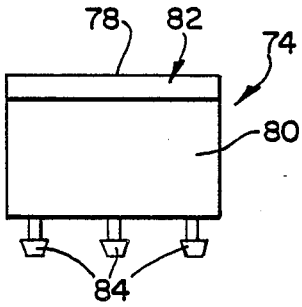
FIG. 21 shows a front end view of one of the screen panels forming the upper deck of the double screen deck shown in FIG. 18.

Referring further to FIG. 18 and to FIGS. 19 and 20, the further screening panels 76 forming the lower deck of the double screen deck 72 have screening surfaces 88 provided with screening apertures 90. It will be understood that the screening apertures 90 are smaller than the screening apertures provided in the screening surfaces 78 of the upper screening panels 74. The screening panels 76 have linear recesses 92 along two opposed sides, and further have half-circular spaced recesses 94 along the edges of the panels in which the linear recesses 92 are provided. The panels 76 are also of a synthetic plastics material.

Figure 22:
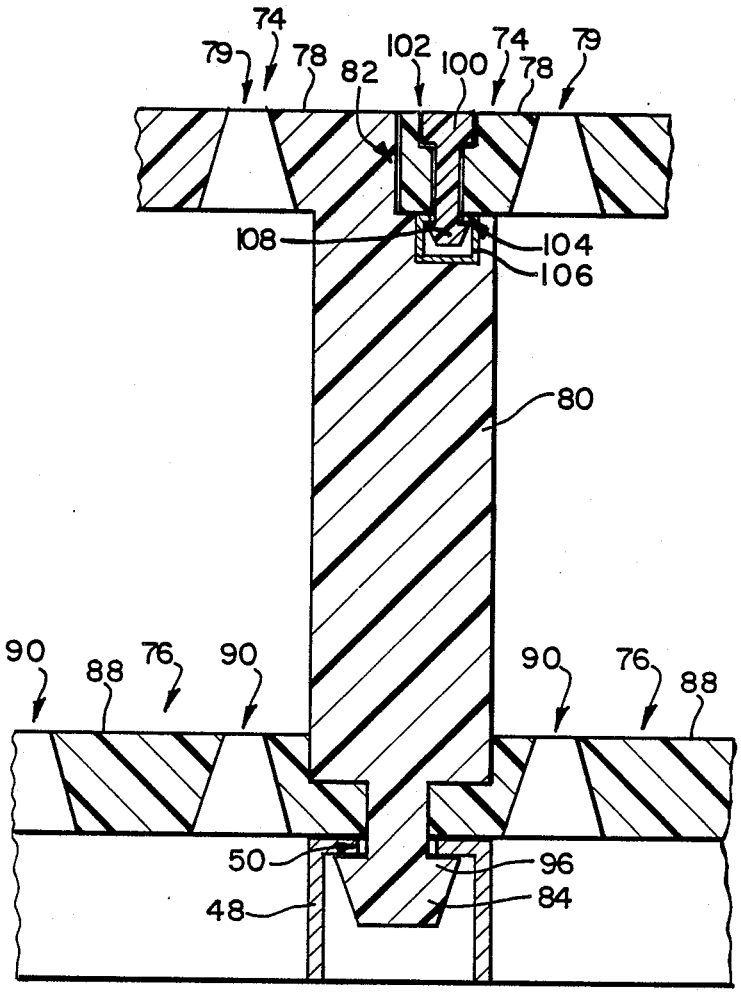
FIG. 22 shows on an enlarged scale a fragmentary sectional view of the double screen deck shown in FIG. 18.

Referring more specifically to FIG. 22, the securing of the panels 74 and 76 to the support frame 48 is shown. The support frame 48 as shown in FIG. 7 has spaced apertures 50. In order to form the screen deck 72 shown in FIG. 18, the panels 76 are first arranged side-by-side on the support frame 48 as shown in FIGS. 20 and 22 so that the linear recesses 92 and the half-circular recesses 94 on adjacent panels oppose each other. The deformable protrusions 84 on the spacer element 80 are then inserted through the circular apertures formed by the half-circular apertures 94 on adjacent panels, and through the apertures 50 in the support frame 48. The enlarged shoulder 96 on the protrusion 84 resists withdrawal of the protrusion from the aperture 50 and thereby secures the spacer element 80 in the recess formed by the opposing recesses 92 in the panels 76. Since the panels 76 are interposed between the spacer element 80 and the support frame 48, the panels 76 are thereby secured on the support frame 48.

Referring further to FIG. 22, the securing of adjacent panels 74 to each other is also shown. the screening surface section 78 of one panel 74 fits into the recess 82 provided on top of the spacer element 80 of an adjacent panel 74. The panels are secured together by means of synthetic plastic pins 100 passing through spaced apertures 102 provided in the screening section 78 of each panel 74 and engaging with the rim 104 of a metal sleeve 106 recessed into the spacer element 80. An enlarged shoulder 108 on the pin 100 resists withdrawal of the pin from the metal sleeve 106 and thereby secures the screen panel section 78 to the spacer element 80. However, since the pin 100 is deformable it may be withdrawn from the metal sleeve 106 in order to release the panel section 78 from the spacer element 80.

If desired, the screen panels 76 may be provided with half-tubular protrusions similar to the half-tubular protrusions 54 shown in FIG. 14 to be spread apart by the protrusions 84 on the spacer element 80 to secure the panels 76 to the support frame 48.

It is an advantage of screening panels in accordance with the invention that by providing spacer elements on the panels integral and unitary with the screening section of the panel so that the panel is substantially L-shaped, a compact panel is provided. Thereby a double screen deck can be formed easily from a minimum number of components. This has the advantage of providing a robust double deck. It has the further advantage that the mass of the double deck can thereby be kept to a minimum, and thereby energy savings may be effected in driving the double deck.

I claim:

1. A screening panel predominantly of a synthetic plastics material and having a screening surface in which screening apertures are provided and having securing means adapted to secure the panel releasably in a side-by-side relationship with similar panels, the panel including one spacer element along one peripheral edge of the panel and extending in a direction transverse to the screening surface of the panel and being integral and unitary with the panel so that in side view the panel is substantially L-shaped, the spacer element being adapted to space the screening surface of the panel from a second screening surface substantially parallel to the screening surface of the panel so that screened material passing through one of the screening surfaces can fall onto the other screening surface to be screened further by that screening surface.

2. A screening panel as claimed in claim 1, in which the spacer element is adapted to support the second screening surface above the screening surface of the panel so that the screening surface of the panel is spaced below the second screening surface.

3. A screening panel as claimed in claim 2, in which the securing means on the screening panel comprises a plurality of deformable spigot-like protrusions spaced from each other along the peripheral region of the panel and being adapted to fit in pairs with the protrusions of an adjacent similar panel in complementary spaced apertures in a support frame.

4. A screening panel as claimed in claim 3, in which the protrusions are solid.

5. A screening panel as claimed in claim 2, which includes securing means at the free end of the spacer element adapted to releasably secure further screening panels forming the second screening surface to the screening panel so that the second screening surface is positioned above the screening surface of the panel.

6. A screening panel as claimed in claim 5, in which the securing means at the free end of the spacer element includes a plurality of spaced sockets.

7. A screening panel as claimed in claim 2, which includes a sloping ridge at the peripheral edge of the screening panel remote from and parallel to the spacer element.

8. A screening panel as claimed in claim 1, in which the spacer element is adapted to space the screening surface of the screening panel above the second screening surface.

9. A screening panel as claied in claim 8, in which the securing means on the screening panel comprises spaced apertures near an edge of the panel and complementary apertures in the spacer element adapted to be aligned with the apertures on an adjacent similar screening panel, and pins adapted to be removably insertable into the aligned apertures to secure an adjacent similar screening panel to the spacer element.

10. A screening panel as claimed in claim 8, which includes securing means at the free end of the spacer element adapted to releasably secure the spacer element and thus the panel to a support frame.

11. A screening panel as claimed in claim 10, in which the securing means on the spacer element are protrusions adapted to releasably engage complementary apertures in the support frame.

12. A screening panel as claimed in claim 10, in which the securing means on the spacer element are adapted to secure a further set of screening panels forming the second screening surface to the support frame.

13. A screening panel as claimed in claim 1, in which an aperture is provided in a sideways direction through the spacer element to permit material on the screening surface of the screening panel to flow in a sideways direction through the spacer element.

14. A screen deck including two decks and a support frame supporting both decks, one deck comprising a plurality of L-shaped screening panels each predominantly of a synthetic plastics material and having a screening surface in which screening apertures are provided and having securing means adapted to secure the panel releasable in a side-by-side relationship with similar panels, the panel including one spacer element along one peripheral edge of the panel and extending in a direction transverse to the screening surface of the panel and being integral and unitary with the panel so that in side view the panel is substantially L-shaped, the spacer element being adapted to space the screening surface of the panel from a second screening surface substantially parallel to the screening surface of the panel so that screened material passing through one of the screening surfaces can fall onto the other screening surface to be screened further by that screening surface, the other deck comprising a plurality of further screening panels forming the second screening surface, the screening panels in each deck being arranged in adjacent longitudinal rows, the decks being vertically spaced from each other.

* * * * *